US011274376B2

(12) United States Patent
Aronsson et al.

(10) Patent No.: US 11,274,376 B2
(45) Date of Patent: Mar. 15, 2022

(54) DEVICE FOR MANUFACTURING HYBRID METAL FOAMS

(71) Applicant: Apollo Energy Systems, Inc., Pompano Beach, FL (US)

(72) Inventors: Robert R. Aronsson, Pompano Beach, FL (US); Barry S. Iseard, Pompano Beach, FL (US); Peter Kalal, Pompano Beach, FL (US)

(73) Assignee: APOLLO ENERGY SYSTEMS, INC., Pompano Beach, FL (US)

( * ) Notice: Subject to any disclaimer, the term of this patent is extended or adjusted under 35 U.S.C. 154(b) by 0 days.

(21) Appl. No.: 17/112,476

(22) Filed: Dec. 4, 2020

(65) Prior Publication Data

US 2021/0087700 A1 Mar. 25, 2021

Related U.S. Application Data

(62) Division of application No. 15/639,232, filed on Jun. 30, 2017, now Pat. No. 10,858,748.

(51) Int. Cl.

| | |
|---|---|
| ***C25D 5/00*** | (2006.01) |
| ***C25D 3/34*** | (2006.01) |
| ***C25D 5/08*** | (2006.01) |
| ***C25D 5/34*** | (2006.01) |
| ***C25D 7/00*** | (2006.01) |
| ***C25C 7/02*** | (2006.01) |
| ***C25D 21/12*** | (2006.01) |

(Continued)

(52) U.S. Cl.

CPC ..... *C25D 5/623* (2020.08); *C25C 7/025* (2013.01); *C25D 3/34* (2013.01); *C25D 5/08* (2013.01); *C25D 5/34* (2013.01); *C25D 7/00* (2013.01); *C25D 21/12* (2013.01); *C23C 18/405* (2013.01); *C23C 18/54* (2013.01)

(58) Field of Classification Search

CPC ..... C25D 5/08

See application file for complete search history.

(56) References Cited

U.S. PATENT DOCUMENTS 3,409,466 A 11/1968 Slay, Jr. et al.
3,581,565 A 6/1971 Dieterich (Continued)

FOREIGN PATENT DOCUMENTS

CN 202543373 U 11/2012
CN 205295509 U * 6/2016

(Continued)

OTHER PUBLICATIONS

Boonyongmaneerat, Y. et al., "Mechanical Properties of Reticulated Aluminum Foams with Electrodeposited Ni-W Coating," Scripta Materialia, 59 (2008) pp. 336-339.

(Continued)

*Primary Examiner* — Ho-Sung Chung

(74) *Attorney, Agent, or Firm* — Pillsbury Winthrop Shaw Pittman LLP

(57) ABSTRACT

A method of electroplating a metal foam includes placing a metal foam to be plated into an electroplating chamber with a plating material source, circulating an electrolyte through the chamber to carry metal ions from the plating material source, the circulating being selected and controlled to produce an even coating of plating material on surfaces of the metal foam.

9 Claims, 5 Drawing Sheets

(51) Int. Cl.

| | |
|---|---|
| *C23C 18/40* | (2006.01) |
| *C23C 18/54* | (2006.01) |

(56) References Cited

U.S. PATENT DOCUMENTS

| | | | | |
|---|---|---|---|---|
| 4,062,755 | A | 12/1977 | Turner | |
| 4,093,466 | A | 6/1978 | Davis | |
| 4,194,913 | A | 3/1980 | Davis | |
| 4,634,503 | A | 1/1987 | Nogavich | |
| 4,978,431 | A | 12/1990 | Brannan et al. | |
| 4,981,559 | A | 1/1991 | Sato et al. | |
| 5,000,827 | A | 3/1991 | Schuster et al. | |
| 5,093,970 | A | 3/1992 | Senoo et al. | |
| 5,098,544 | A | 3/1992 | Brannan et al. | |
| 5,223,354 | A | 6/1993 | Senoo et al. | |
| 5,248,527 | A | 9/1993 | Uchida et al. | |
| 5,260,234 | A | 11/1993 | Long | |
| 5,514,258 | A | 5/1996 | Brinket et al. | |
| 5,584,983 | A | 12/1996 | Pruyn | |
| 5,688,615 | A | 11/1997 | Mrotek et al. | |
| 5,804,053 | A | 9/1998 | Vaccaro et al. | |
| 6,517,698 | B1 | 2/2003 | Johnson et al. | |
| 6,521,102 | B1 * | 2/2003 | Dordi | C25D 7/0642 204/252 |
| 6,746,578 | B2 | 6/2004 | Barrese et al. | |
| 6,933,008 | B2 | 8/2005 | Bugnet et al. | |
| 6,942,781 | B2 | 9/2005 | Kuhn et al. | |
| 6,984,302 | B2 | 1/2006 | Lee | |
| 7,192,509 | B2 | 3/2007 | Karl et al. | |
| 7,299,177 | B2 | 11/2007 | Broman et al. | |
| 8,110,076 | B2 | 2/2012 | Ettel | |
| 8,968,533 | B2 | 3/2015 | Harris et al. | |
| 2001/0050233 | A1 | 12/2001 | Uzoh | |
| 2002/0108850 | A1 | 8/2002 | Sakaki | |
| 2009/0217812 | A1 * | 9/2009 | Whitaker | F41H 5/04 89/36.02 |
| 2013/0186852 | A1 | 7/2013 | Dietrich et al. | |

FOREIGN PATENT DOCUMENTS

| | | | |
|---|---|---|---|
| CN | 205295509 | U | 6/2016 |
| CZ | 9600705 | A3 | 11/1997 |
| DE | 3919073 | A1 | 12/1990 |
| JP | S 60-24397 | A | 2/1985 |
| JP | S63-007392 | A | 1/1988 |
| JP | S63007392 | A * | 1/1988 |
| JP | H 01-156494 | A | 6/1989 |
| JP | H 11-229196 | A | 8/1999 |

OTHER PUBLICATIONS

Vilar, E. O., et al., "Mass Transfer to Flow-Through Thin Porous Electrodes under Laminar Flow," Electrochimica Acta, vol. 40, No. 5, pp. 585-690, 1995.

Jung, A., et al., "Electrodeposition of Nanocrystalline Metals on Open Cell Metal Foams: Improved Mechanical Properties," ECS Trans 2010, vol. 25, Issue 41, pp. 165-172.

Jung, A., et al., "Hybrid Metal Foams: Mechanical testing and Determination of Mass Flow Limitations during Electroplating," International Journal of Materials Science, vol. 2, Issue 4, Dec. 2012.

Jung, A., et al., Open Cell Aluminum Foams with Graded Coatings as Passively Controllable Energy Absorbers, Advanced Engineering Materials, vol. 13, Issue 1-2, Feb. 2011, pp. 23-28.

Li et al., machine translation, CN 205295509 U (Year: 2016).

Yamashita, machine translation, JP S63-7392 A (Year: 1988).

Li et al. ,partial human translation, CN 205295509 U (Year: 2016).

Yamashita, partial human translation, JP S63-7392 A (Year: 1988).

* cited by examiner

FIG. 1a
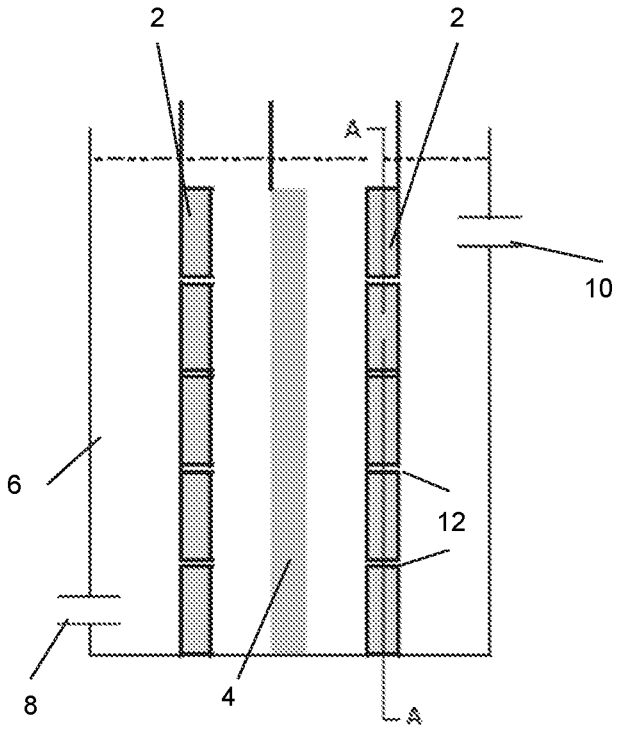
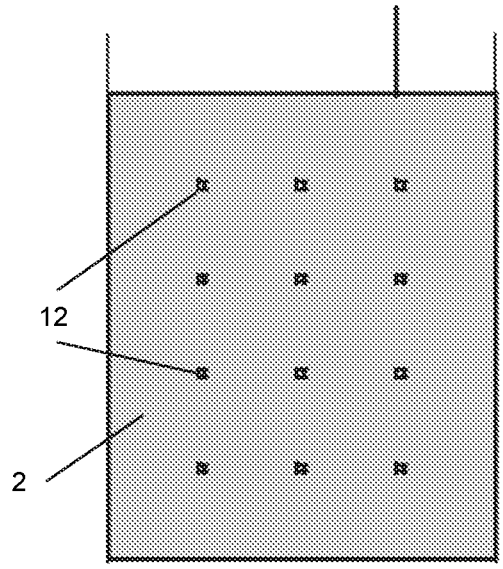
FIG. 1c
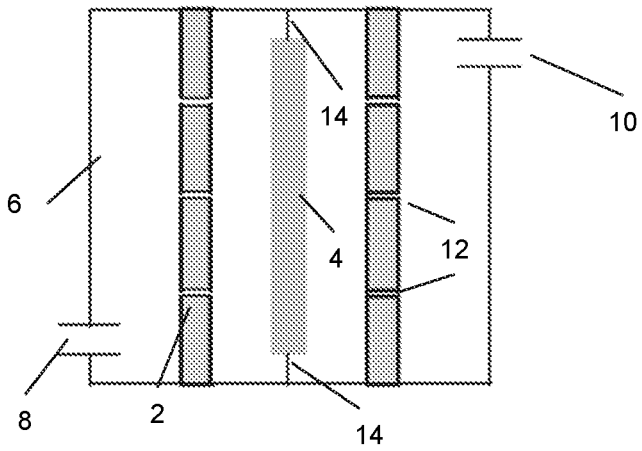
FIG. 1b

DEVICE FOR MANUFACTURING HYBRID METAL FOAMS

CROSS-REFERENCE TO RELATED APPLICATIONS

This application is a divisional of U.S. application Ser. No. 15/639,232, filed Jun. 29, 2017. The content of this application is incorporated herein by reference in its entirety.

BACKGROUND OF THE INVENTION

Open celled metal foam, also called metal sponge, is used in heat exchangers, energy absorption, flow diffusion, and lightweight optics in the fields of advanced technology, aerospace, battery electrodes and manufacturing.

Reticulated or open cell foam, is a porous, low density, solid foam. Reticulated foams are extremely open foams, i.e., there are few, if any, intact bubbles or cell windows. Void space may be greater than about 90% and is frequently as high as about 97%. In contrast, the foam formed by soap bubbles is composed solely of intact (fully enclosed) bubbles. In reticulated foam only the lineal boundaries where the bubbles meet remain in the majority of the material.

SUMMARY AND OBJECTS OF THE INVENTION

In an embodiment, a method of electroplating a metal foam, includes placing a metal foam to be plated into an electroplating chamber with a plating material source, circulating an electrolyte through the chamber to carry metal ions from the plating material source, the circulating being selected and controlled to produce an even coating of plating material on surfaces of the metal foam.

An aspect of an embodiment is a chamber for performing the foregoing method.

An aspect of an embodiment is a metal foam produced by the foregoing method.

BRIEF DESCRIPTION OF THE DRAWINGS

The invention may be better understood with reference to the drawings:

FIGS. 1*a-c* illustrate an embodiment of an electroplating cell configuration;

DETAILED DESCRIPTION OF THE INVENTION

Figure 2B:
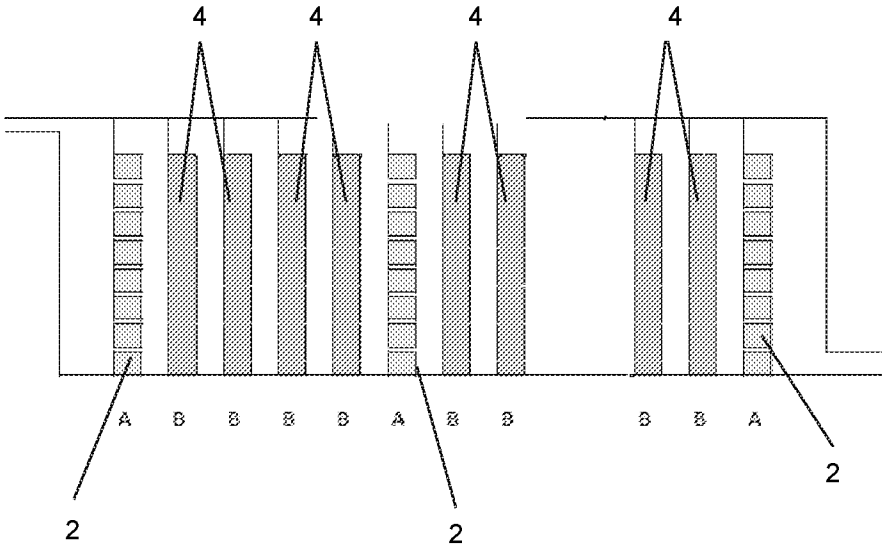
FIGS. 2*a* and 2*b* illustrate two embodiments of a cell for plating multiple copper foam electrodes.

A number of direct methods have been developed for making metal foams, examples of which include: bubbling gas through molten alloys, stirring a foaming agent into a molten alloy and controlling the pressure while cooling, consolidation of a metal powder with a particulate foaming agent followed by heating into the mushy state when the foaming agent releases hydrogen, expanding the material, manufacture of a ceramic mold from a wax or polymer-foam precursor, followed by burning-out of the precursor and pressure infiltration with a molten metal or metal powder slurry which is then sintered, vapor phase deposition of a metal onto a polymer foam precursor, such as polyurethane, which is subsequently burned out, leaving cell edges with hollow cores, e.g., nickel from nickel tetracarbonyl for nickel foams, electrodeposition of a metal onto a conductive layer of graphite on the substrate reticulated foam such as polyurethane, and electroless plating of a metal directly onto the substrate reticulated foam such as polyurethane. At least the vapor phase deposition, electrodeposition, and electroless plating methods can be used to produce open-cell (reticulated) metal foam.

In a conventional lead-acid battery, the solid lead grid is the means of support of the active material, but weighs roughly 50% of the weight of the pasted plates. Unframed open cell metallic foam can weigh as little as 16% of the conventional grid but still contain more active material than a conventional grid. This gives a potentially higher energy density for the battery. Furthermore, the average distance between a particle of active material and the foam current collector structure is much smaller, thus decreasing the current pathways and potentially allowing for fast charge and discharge, i.e., a higher power density than a conventional lead-acid battery. The shorter distance may also allow for greater active material utilization.

However, one reason for the lead grid being so heavy with relatively thick members is the relatively low electrical conductivity and softness of the metal. This is to a certain extent alleviated by alloying with a material like antimony, but typically, further reduction in weight will tend to be at the expense of grid conductivity, strength and battery lifetime. A lead/antinomy alloy foam electrode would not tend to provide sufficient electrical conductivity for a conventional size lead-acid battery, and it would typically require very thick and substantial strengthening supports, which obviates a portion of the weight savings from using the foam in the first place, thus diminishing the advantages of the metallic foam.

Because the chemical reactions in a battery occur primarily at the surface of the electrode plates, the material content of the surface of the grid is a key to performance. That is, as long as the lead-containing active material can be in contact with lead on the surface of the grid, the electrochemical processes during "plate" formation and charge/discharge will occur.

As will be understood by the skilled artisan, copper is a metal which has many desirable properties for use in electrical systems. It is highly electrically conductive, and structurally stronger than lead while also being less dense. Reticulated copper foam can be produced by the above described methods, to produce a metallic foam that is lighter, stiffer and much more electrically conductive than metallic lead.

Lead electroplated on copper, an example of a hybrid metallic foam, can take advantage of these desirable properties and function as electrodes in advanced lead-acid batteries. Some additional degree of stiffening around the edges may be useful in some applications, and when used as the positive electrode in a lead acid battery, it can contribute to producing an even thickness of lead coating.

Though the examples herein are focused on lead on copper hybrid foams, the principles may find application to other metallic foams or other metallic materials having internal channels that are to be electroplated with a second metallic material, particularly in the case that the plating is to be evenly applied. A major application of such structures is use as a battery or fuel cell electrode where a selected active metallic material should be evenly applied throughout a three dimensional structure onto a substrate metal.

Deposition of a metal onto a foam substrate may be performed by way of one of three broad approaches to produce a hybrid metal foam. These methods, usually carried out in aqueous solution, are electroless deposition, displacement deposition, and electroplating.

Electroless deposition (i.e., plating) does not require use of an electrical current, and in many instances can be employed when there is no electrochemical pathway available. In broad terms, a substrate to be plated is placed into solution with the metal ions to be plated and a reducing agent with a redox potential less positive than the metal is supplied. For example, copper can be electrolessly plated using a reducing agent such as formaldehyde (methanal).

One issue with this approach is that it may be difficult to control the evenness of the deposition, and a variety of conditions must be met in order to achieve an even cohesive plate thickness. For example, the copper ions generally need to be complexed in order to prevent precipitation as the pH changes. Buffers may be needed to keep the pH within a narrow range. Finally, stabilizers may need to be added as electroless plating solutions tend to be inherently unstable. Even though the surface to be plated can be activated to preferentially receive the plating, it may be difficult to prevent a significant deposit on the walls of the container and other surfaces, thus reducing the efficiency of the process. Wide variations in result can occur due to small variations in surface morphology, cleanliness of the surface, and impurities in the solution. Thus, significant effort may be required to prepare the substrate prior to plating. In the case of lead, the redox potential (−0.126V) is too negative for most reducing agents, so lead is rarely electroplated using an electroless method.

Displacement deposition, like electroless plating, does not require an external current. In this case the metal to be plated is immersed in a solution containing ions with a higher redox potential. That is, the metal to be plated itself acts as the reducing agent and supplies the necessary electrons. For example, a zinc substrate is immersed in a copper sulfate solution. The standard electrode potential of $Zn/Zn^{++}$ (−0.763V) is lower than that of $Cu/Cu^{++}$ (+0.337V), causing zinc to displace copper by:

$$Zn \rightarrow Zn^{++} + 2e^{-}$$

$$Cu^{++} + 2e^{-} \rightarrow Cu$$

The zinc dissolves in the solution and copper is plated on the remaining surface of the zinc, the overall reaction with no external circuit being, by addition of the two above equations:

$$Zn + Cu^{++} \rightarrow Zn^{++} + Cu$$

This is a good method to produce a thin layer of the second metal on the substrate, but the thickness of such a layer is self-limiting because the displacement deposition needs an exposed surface of the substrate material in order to proceed. Once all of the zinc is covered with a copper layer, it is no longer available for dissolution into the solution to provide electrons to the copper.

Moreover, if the goal is a lead/copper electrode, this method cannot work. Specifically, lead will not plate on copper by displacement deposition because the standard electrode potential of copper in $Cu/Cu^{++}$ (+0.337V) is higher than that of lead in $Pb/Pb^{++}$ (−0.126V). As will be appreciated, this can be generalized to any pairs in which the substrate material has a higher electrode potential than the desired coating material does.

Electroplating is widely employed to make a coating of one metal on another metal. The coating metal has the desirable properties such as luster, appearance, corrosion resistance, electrochemical behavior, high electrical conductivity, and hardness.

Unlike electroless plating, the electroplated coating thickness, quality and the electroplating rate can be easily controlled by varying the potential, current concentration, time and other easily controlled parameters.

The standard potential for lead in aqueous solutions is −0.126V. This metal has a high hydrogen overpotential, which means that it is easily deposited electrolytically from strongly acidic solutions with a cathodic efficiency approaching 100%. The values for the hydrogen overpotential are dependent on the surface and structure of the electrode and are given in the literature as varying between 0.84V for 99.8% pure Pb to about 1.2V for electrolytically deposited coatings. The electrochemical equivalent for the reaction $Pb_2^{+} + 2e- \rightarrow Pb$ is 3.865 $gAh^{-1}$. The lead deposition can be used for coulometric determinations because of the high cathodic current efficiency.

Electroplating is usually applied to non-porous surfaces. In a typical arrangement, the metal to be coated is made the cathode (positive) electrode, and the electrolyte contains the positive (metallic) ions of the metal to be plated. To maintain balance of the positive ions, the anode is of the same metal (i.e., a sacrificial anode).

For example, for electroplating with copper, the sacrificial copper anode loses electrons and goes into solution as hydrated copper ions. These ions flow through the solution to the cathode.

$$Cu \rightarrow Cu^{++} + 2e^{-}$$

The cathode, which is the metal to be plated with copper, receives the electrons from the circuit and the copper ions close to the cathode receive these electrons to become copper, which plates on the surface of the metal.

$$Cu^{++} + 2e^{-} \rightarrow Cu$$

This is a simplified account of the actual process of electroplating. In a bulk solution where electroplating is being carried out, positive ions are moving towards the cathode and negative ions are moving towards the anode. In aqueous solutions, these ions may contain water molecules. For example, the copper ion may be surrounded by six water molecules as the hydrated copper ion more correctly written as $Cu(H_2O)_6^{++}$.

When these positive ions approach the cathode, a number of processes occur in the region close to the electrode, resulting in the ion losing the water of hydration and gaining electron(s) to become atoms.

Certain conditions are required to produce a homogenous electroplated deposit of even thickness. These conditions include temperature, cleanliness of surface, surface preparation & morphology, plating current magnitude & waveform and composition of electrolyte. In particular, there should be a certain degree of agitation of the electrolyte, especially at high current density when the natural diffusion of the ions is insufficient to make up the loss of concentration at the electrode surface, as the ions gain electrons to form the plated metal. This happens when ions are removed more quickly from the electrolyte than they are replenished by diffusion from the bulk electrolyte into the concentration zone adjacent to the electrode. With insufficient agitation &/or excessive current, uneven plating and dendrite formation can occur.

For conventional electroplating, limiting the current and simply stirring the electrolyte can achieve desirable evenness of deposit. Dendrite formation and uneven plating can be reduced by the addition of an inhibitor to the solution. Sufficient stirring rate will tend to produce a turbulent flow thereby improving the supply of ions to the concentration zone. Applying a pulsed current can further enhance the electroplating. During the duty cycle, when the current is "on", the concentration zone is depleted of metal ions due to the electroplating process. During the "off" periods, natural diffusion will replenish the concentration zone. Ion mobility and viscosity will determine the diffusion rate at a particular temperature. Diffusion rate and desired electroplating current will determine the duty cycle of the pulse.

Even if the cathode to be electroplated is of an irregular shape, the electroplating process is essentially line-of-sight, which means that surfaces facing the anode directly will tend to accumulate thicker coatings than surfaces that face away or that are obscured in a complex geometry. However, if the electrolyte is in contact with the surface and there is sufficient movement of electrolyte, then there are no mass transport limitations and electroplating can be made successful by fulfilling the other conditions mentioned above.

Nearly all objects to be electroplated are non-porous and do not possess spaces inside the main structure which require electroplating, consequently stirring is required but no directed flow is necessary.

Three-dimensional reticulated metallic foam presents a situation where there can be mass transport limitations under conditions where bulk electroplating can be carried out. Whereas the outside surface can be electroplated in a similar fashion as a bulk cathode, the inside surfaces are not in line-of-sight with the exterior electrolyte, and mass flow limitations occur.

Conventional stirring of the electrolyte will only cause flow within a very small distance inside the bulk foam surface. With a non-pulsed current, electrodeposition tends to diminish rapidly with distance from the geometric outside of foam. This is due to depletion of electrolyte ions which are not replaced by diffusion due to the comparatively greater distance from the bulk electrolyte outside the foam. To a certain extent, pulsing the DC current improves the evenness of electrodeposition through the foam cathode. There is a complex relationship between coating thickness homogeneity and electroplating current, electrolyte concentration, electrolyte temperature, electrolyte flow and geometry of the foam electrode.

FIGS. 1*a-c* show views of an embodiment of the simplest electrode configuration having two positive lead electrodes 2 with a copper foam negative electrode 4 between them. By the design of the cell vessel 6, the electrolyte is constrained to flow through all three electrodes.

Electrolyte flows into the cell vessel 6 via inlet 8 on the left hand side of the figure. An outlet 10 is provided at the opposite side. Each of the lead electrodes 2 has through holes 12 that are configured to allow fluid flow therethrough. Because the copper electrode 4 is a foam, it likewise is able to accommodate a through fluid flow. Thus, the fluid passes through and around each of the electrode plates, 2, 4, as it flows from the inlet to the outlet. The barriers 14 at the ends of the copper foam electrode 4 constrain flow to ensure that it passes through, rather than around, the copper foam electrode 4.

In general, Metal A (in the illustrated case, copper) can be any metal or alloy which can be produced as reticulated foam, which can be electroplated with another metal or alloy. In general, Metal B (lead in the illustrated case) can be any metal which is stable in the electrolyte and can be configured as an anode as described in this invention, and which can produce positive ions for electroplating on Metal A.

One particular application of this approach is used to produce a lead-acid battery with enhanced performance by means of directing the flow of electrolyte through metallic foam such as copper (an example of Metal B) in order to electroplate a metal such as lead (an example of Metal A) with a fairly even coating throughout the width and thickness of the foam. This hybrid lightweight metal foam has a high surface area and can replace the conventional grid in a lead-acid battery, thereby producing lead-acid batteries with high energy and power density.

The velocity of electrolyte flow through the foam is important for successful electroplating throughout the foam. In an embodiment, a turbulent flow of electrolyte is generated in a general direction through a foam electrolyte, at right angles to the plane of the electrode. The electrolyte is forced through the foam by designing the cell with pumped (not stirred) circulation of electrolyte, with no by-pass around the foam electrode. For electroplating Metal A onto Metal B (in the form of reticulated metal foam), a flat piece of Metal A can combine the function of anode with that of a plenum to provide jets of electrolyte to impinge on the Metal B foam. In one embodiment, this is achieved by drilling holes in the Metal A anode and having a reservoir behind the electrode. The electrolyte is pumped into the reservoir, travels through the channels in the Metal A anode, then through the Metal B foam. After passing through the cell, the electrolyte returns to the pump. Thus the electrolyte circulation is forced through the foam. The cell can contain several Metal A foam cathodes and a Metal B anode immediately before the exit reservoir. The cell is symmetrical, allowing for the flow of electrolyte to be reversed. During flow in one direction, the Metal B in the foam nearer the Metal A anode through which the electrolyte has been channeled is exposed to a higher concentration of positive ions from Metal A in the electrolyte than sections of Metal B foam downstream, thereby causing faster build-up of electroplated Metal A on Metal B upstream compared to downstream, i.e., a thicker deposit of Metal A. By reversing the direction of flow, the sections of Metal B in the foam which were upstream are now downstream, and vice-versa. By timing each electrolyte flow direction the same, the preferential coating is cancelled out and the evenness of the coating is improved.

It is well known that in fluid dynamics the walls of a channel through which a fluid is directed have a drag effect on the fluid and the velocity close to the walls is lower than the velocity on the center line. Likewise, the frame of the Metal B foam, and the walls of the cell can exert a drag on the flow of electrolyte near these edges. The exact differential in velocity of electrolyte is best determined experimentally, by drilling channels of equal diameter and spacing in the Metal A anode and measuring the plating thickness thus produced by weighing small sections of electroplated foam of equal geometric area, comparing pieces from the center of the foam to pieces from near the edge. Subsequently, by trial and error, the channels through the lead anode can be altered near the periphery to produce the same electrolyte velocity through the foam cathode at the edges as near the center, thereby evening out the electroplating thickness. In principle, this complex fluid dynamics problem can be modeled and the appropriate position and size of holes can be calculated.

Electroplating cells containing multiple Metal A anodes and multiple Metal B foam cathodes may be contemplated according to this invention. In another version, the incoming electrolyte may be introduced to the electroplating cell between the Metal A anode and the Metal B foam cathode, but a plastic barrier with holes drilled through can now serve to distribute the flowing electrolyte in front of the Metal B foam, so that the velocities of flow through the Metal B foam are the same throughout its width. The same arrangement in reverse will be at the other end. The lead plates at the ends now only serve as anodes and there is a separate plenum in front of the first piece of copper foam through which the electrolyte flows. Other lead anode/plenums and additional copper foam cathodes may be introduced between these ends. These embodiments are illustrated in FIGS. 2*a* and 2*b*.

Figure 2A:
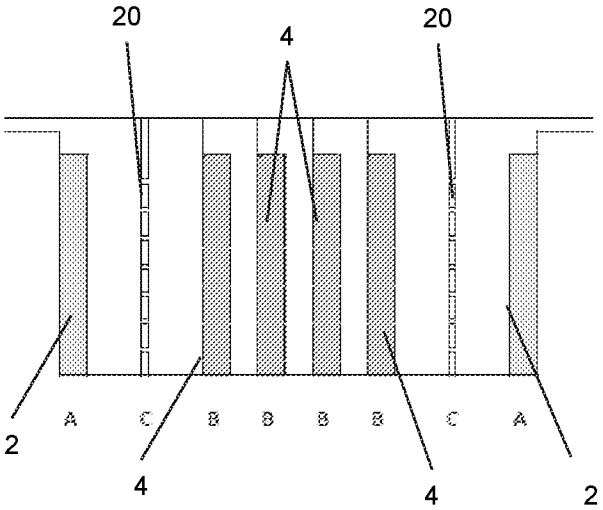

In FIG. 2*a*, multiple copper foam electrodes 4 are electroplated between two lead electrodes 2 (electrical connections not shown). FIG. 2*a* also shows an alternative to having the electrolyte passing through the lead, by means of inserting between the lead negatives and the leading copper positive a plastic barrier 20 with the electrolyte directing holes drilled therein. Horizontal laminar flow of electrolyte is achieved, but there may be some loss of consistency of $Pb^{++}$ concentration impinging on the surface of the copper foam, because flow rates of electrolyte and concentrations of $Pb^{++}$ ion concentrations in the upper levels of the electrolyte will generally not be the same as with the lower levels near the bottom of the cell. This is because in this example, the electrolyte inlet and outlet are both at the top of the cell, so the distance lead ions travel through the top layers tends to be less than the distance travelled through the lower layers. The inlet and outlet may be positioned at different heights than shown.

The configuration in FIG. 2*b* may allow for a reduction of concentration gradients of $Pb^{++}$ by forcing the electrolyte through multiple lead sheet anodes and multiple copper foam cathodes electrically connected in parallel (electrical connections not shown). The principles are similar to the simple cell in FIG. 1.

Example 1

A particular example embodiment is described in which copper foam is electroplated with lead to produce a lightweight high surface area grid for a lead-acid battery.

Figure 3:
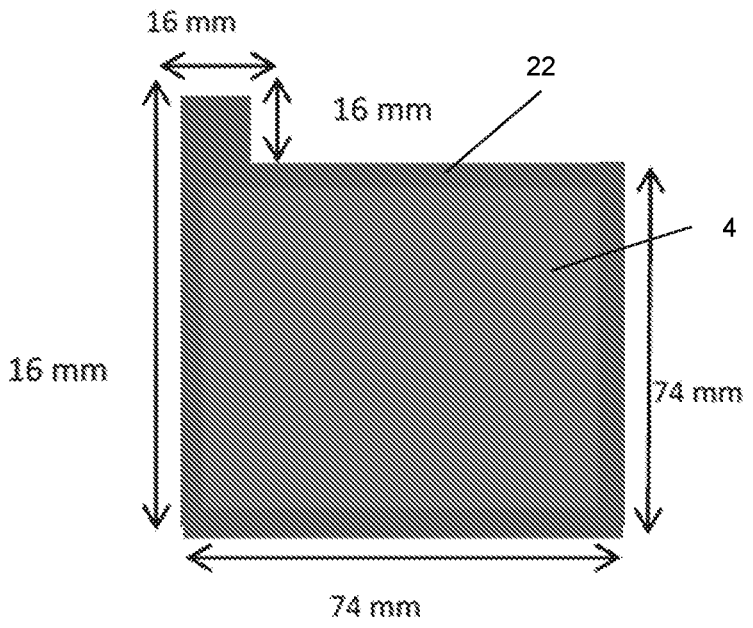
FIG. 3 illustrates a copper foam electrode in accordance with an embodiment.

Copper foam is cut into the shape of an electrode 4 as shown in FIG. 3. The copper electrode is modified and cleaned in preparation for electroplating, and then the directed flow electroplating is carried out according to the procedure below. The plate has a thickness, for example, of 2.5 mm and has reinforced edges 22. The dimensions as shown may be suitable for a small lead-acid cell, though the skilled artisan will understand that other dimensions may be used and the illustrated dimensions are not limiting. This design can be scaled up for large industrial size plates of height between about 20 cm and 30 cm. During plating, the electrolyte is forced to flow through the copper foam with no by-pass by placing a barrier around the sides and bottom of the copper foam electrode in the electroplating cell.

Example 2

A lead plated copper plate was produced. Lead (II) tetrafluoroborate ($Pb(BF_4)_2$) was placed in solution with boric acid $H_3BO_3$ and an inhibitor. As in the schematic of FIG. 1*a* and 2*b*, the cell design included an electrolyte inlet and outlet on opposite sides and heights (i.e., inlet on the lower left and outlet on the upper right). This arrangement was selected to allow the length of each electrolyte pathway inside the cell between inlet and outlet to be as similar as possible. This may help to reduce inhomogeneity of electrolyte and to maintain uniformity of deposition. While this example involves $Pb(BF_4)_2$ in solution with $H_3BO_3$ and an inhibitor, any other electroplating methods should work equally well as long as similar flow arrangements are made.

The two lead electrodes were respectively positioned close to the electrolyte inlet and the outlet. These electrodes were attached to the bottom and side walls of the electroplating cell. Each lead electrode of typical thickness 0.25 cm-1 cm had a number of holes drilled through. The walls of the vessel were configured to prevent flow around the edges of the electrode plates.

The overall dimensions of the lead electrodes were slightly larger than the copper foam to be electroplated. Thus, the electrolyte was forced to flow through the holes. The total cross sectional area of the holes was selected to be sufficient for the required electrolyte flow required to electroplate the lead on the copper foam at the required rate. For example, the holes may be in the range of about 5-12% and more particularly 7-10%, though larger ranges are likewise possible.

In an alternate embodiment, the vessel may include flanges forming slots into which the electrode plates are placed to form a seal.

The lead negatives can be used repeatedly for electroplating many samples of copper foam, but are consumed in the process. Once the holes become too wide to direct the flow &/or the lead electrodes become too thin or perhaps irregular, they must be replaced.

Figure 6:
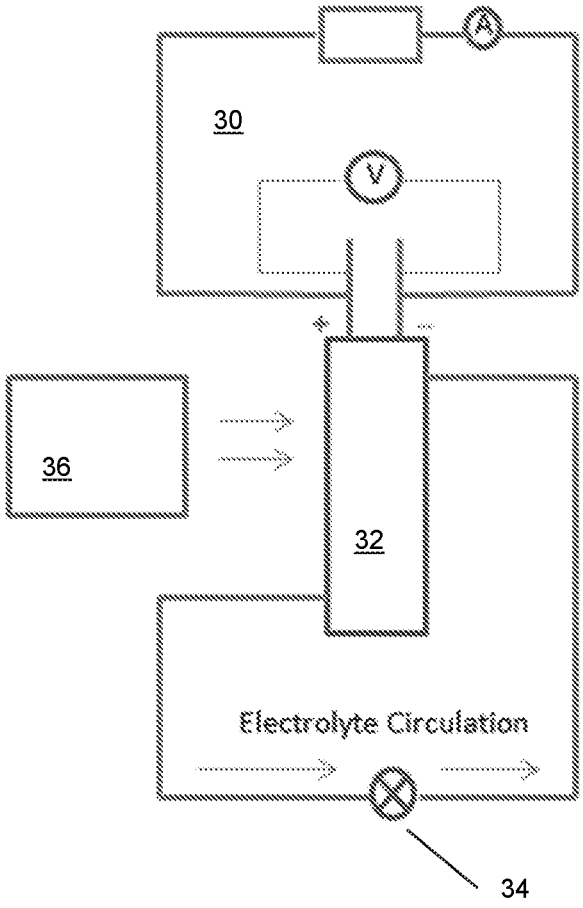
FIG. 6 schematically illustrates an apparatus for electroplating in accordance with an embodiment.

FIG. 6 is a typical schematic of the basic set-up for circulating electrolyte, passing charge through the cell and measuring current and voltage and maintaining the electrolyte above room temperature.

A power supply 30, which may be, for example, a DC power supply configured to produce 0 to 12V supplies voltage to the electroplating cell 32. Electrolyte is circulated through the cell 32 via a pump 34. The pump 34 may be reversible, to allow for reversal of fluid flow through the cell. In an embodiment, the pump 34 may include a controller that allows for pulsing, change of flow direction, change of flow rate, or other methods of modifying the circulation of electrolyte through the cell. Optionally, a heater 36 may be provided to heat the cell to increase reaction rates. In an embodiment, the heater 36 is an air circulation heater, though other approaches may be used.

The above descriptions refer mainly to evening the electrolyte flow characteristics and preventing the formation of areas of zero electrolyte flow within the pores of the lead foam with the resultant depletion of ions and uneven deposition caused by this. It should be appreciated that the electroplating cell configurations described herein will apply in general, to any metal or alloy which can be produced as reticulated foam (A), which can be electroplated with another metal or alloy (B). In general, Metal B can be any metal which is stable in the electrolyte and can be configured as an anode as described in this invention, and which can produce positive ions for electroplating on Metal A. One example used in the fabrication of a lead-acid battery electrode by plating lead on copper foam, is given below.

Figure 7:
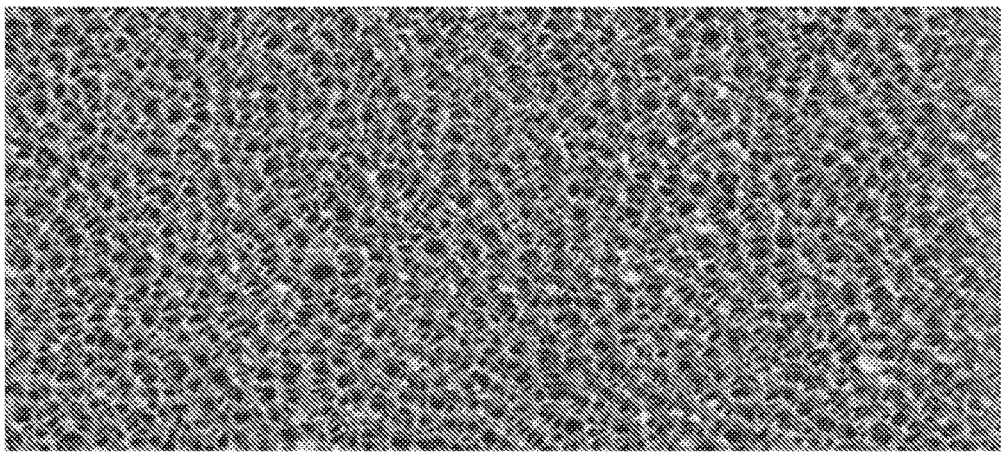
FIG. 7 is a photomicrograph of a reticulated copper foam in accordance with an embodiment.

Example Procedure:

1. Wash copper foam (as shown in FIG. 7) with acetone.

2 Determine weight/area: calculate areal density of all samples.

3 Cut to the desired shape, take weight. FIG. 3 illustrates an example of a plate that has been cut to shape as described.

4 Create 5 mm edges/tab by partial compression using rounded piece of Plexiglas and 1.7 mm spacers.

5 Clean with hydrochloric acid (HCl) pickle, 7.5% at room temperature (RT) for 120 sec.

6 Dip into relatively hot Pb to create the frame, wash, dry, take weight: "tinned"

7 Re-clean with the HCl pickle, RT, 60 sec.

Figure 4:
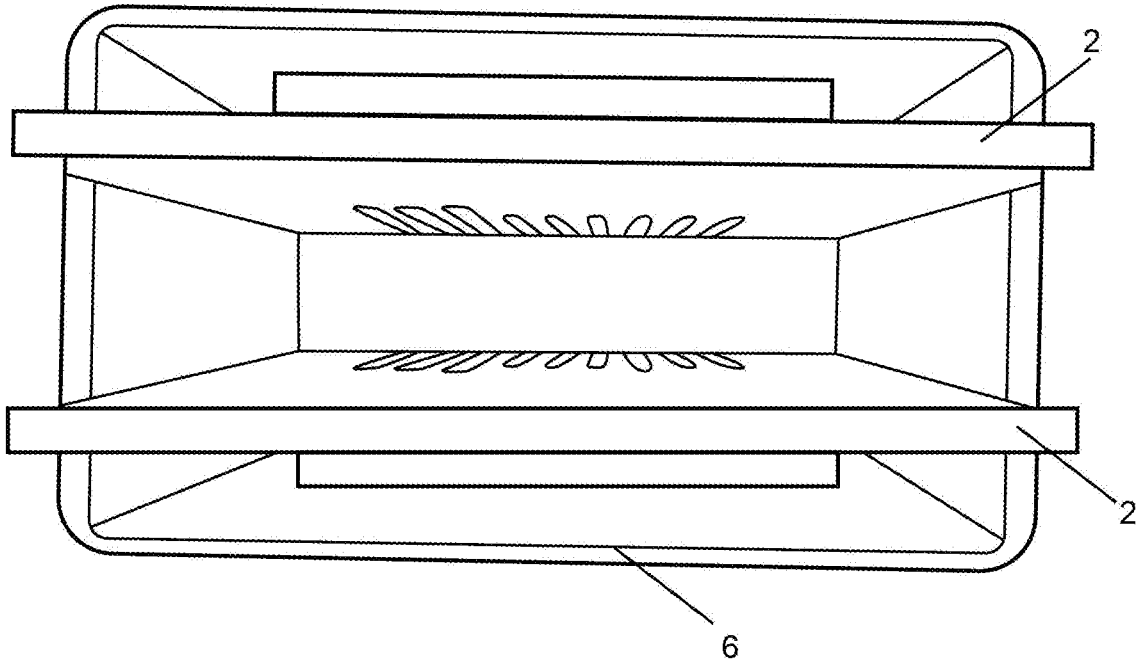
FIG. 4 is a top view photograph of a pair of flow through electrodes in accordance with an embodiment.
Figure 5:
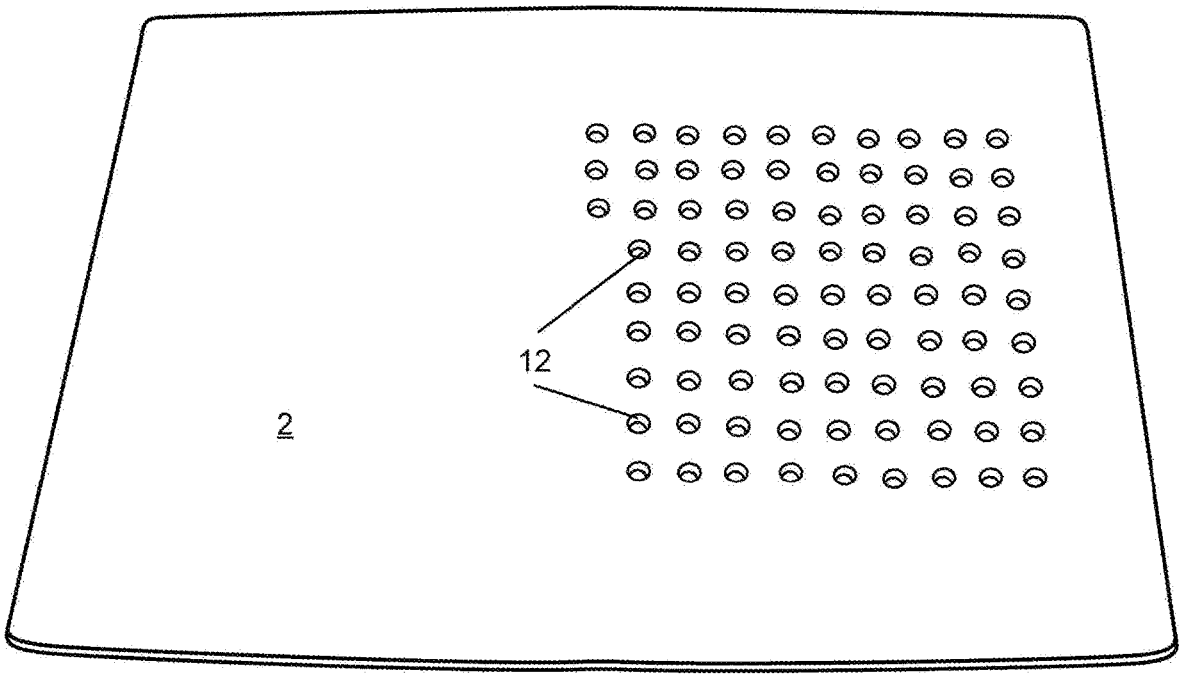
FIG. 5 is a photograph of an electrode in accordance with an embodiment.

8 Wash and immediately plate with lead in the directed flow cell while mildly heating (e.g., ~35-45 deg. C.) and stirring using the electroplating cell and components in FIGS. 4, 5 & 6.

9 Wash, dry, take final weight.

10 Calculate final lead thickness and plating efficiency.

In an embodiment, during the electroplating process, the flow of electrolyte relative to the copper foam is reversed several times. This is achieved either by periodically reversing the flow of electrolyte into the cell; or by rotating the copper foam in the cell by 180°. In that way, the effects of a slightly lower electrolyte concentration (and other physical conditions effecting plating) on the downstream side of the copper foam compared to the upstream side is cancelled out.

In an example, electrolyte flow velocity may be estimated as follows:

A pump has a rated capacity of 500 GPH, i.e., 31.55 LPM. The actual measured electrolyte flow is only 4 LPM. In the example, the area of the box face is 9.5 cm by 11.0 cm=104.5 $cm^2$. 4 LPM=4000 $cm^3min^{-1}$/104.5 $cm^2$=38.3 cm/min or 6.5 mm/s.

Similarly, electrolyte flow velocity through the holes in the lead sheet can be calculated for the example. If there are 84 holes, the flow through each hole is 4000 $cm^3min^{-1}$/84=47 $cm^3$/min. If each hole has a diameter of 3.5 mm, the area is then 0.096 $cm^2$. Dividing flow through each hole by the hole's area, we obtain 47 $cm^3min^{-1}$/0.096 $cm^2$=495 cm/min or 83 mm/s. In this example, the holes represent approximately 7.7% of the total area of the plate.

Summary of Typical Results

| 2.6 mm Foam properties | | | | | | | | | | | | | |
|---|---|---|---|---|---|---|---|---|---|---|---|---|---|
| # | A.D. [g/m2] | Rel. dens. [%] | As cut [g] | Framed [g] | Frame [g] | d [cm] | Free area [cm2] | X1 [—] | Free area surface [cm2]2 | Edges area [cm2] | Tot. A [cm2] | Tgt Pb d [μm] | Tgt Pb m [g] |
| 1 | 1,207 | 5.2 | 6.92 | 21.515 | 14.6 | 0.26 | 42.3 | 3.5 | 147.9 | 33.5 | 181.4 | 65 | 14.17 |
| 2 | 1,233 | 5.3 | 7.07 | 20.92 | 13.85 | 0.26 | 42.3 | 3.5 | 147.9 | 33.5 | 181.4 | 65 | 14.17 |
| 3 | 1,093 | 4.7 | 6.267 | 17.741 | 11.47 | 0.26 | 42.3 | 3.5 | 147.9 | 33.5 | 181.4 | 65 | 14.17 |
| 4 | 1,091 | 4.7 | 6.254 | 22.175 | 15.92 | 0.26 | 42.3 | 3.5 | 147.9 | 33.5 | 181.4 | 130 | 28.34 |
| 5 | 1,085 | 4.7 | 6.221 | 19.222 | 13 | 0.26 | 42.3 | 3.5 | 147.9 | 33.5 | 181.4 | 130 | 28.34 |
| | 1,142 | 4.9 | | Avg. | 13.77 | | | | | | | | |
| | | | | Std. | 1.672 | | | | | | | | |

| | Experimental details | | | | | | Lead loading data | | | | |
|---|---|---|---|---|---|---|---|---|---|---|---|
| # | C.D. [mA/cm2] | I [A] | Ch [Ah] | t [min] | U [V] | Stir. [rpm] | Fin. wt. [g] | Pb gain [g] | Plating η [%] | Pb V [cm3] | Pb h [μm] |
| 1 | 20 | 3.63 | 3.67 | 60.6 | 0.18 | FLOW | 35.43 | 13.9 | 98.2 | 1.158 | 63.8 |
| 2 | 20 | 3.63 | 3.67 | 60.6 | 0.18 | FLOW | 34.596 | 13.7 | 96.5 | 1.138 | 62.7 |
| 3 | 20 | 3.63 | 3.67 | 60.6 | 0.19 | FLOW | 31.416 | 13.7 | 96.5 | 1.138 | 62.7 |
| 4 | 20 | 3.63 | 7.33 | 121 | 0.18 | FLOW | 49.741 | 27.6 | 97.3 | 2.293 | 126 |
| 5 | 20 | 3.63 | 7.33 | 121 | 0.16 | FLOW | 46.559 | 27.3 | 96.5 | 2.274 | 125 |

Table 1 summarizes the results of the foregoing example and shows a high efficiency of lead electroplating (96.5%-98.2%) with three samples with a thinner coating (60.6 min) and two samples with a thicker coating of lead (121.3 min).

Samples of lead coated copper foam according to the description above and results shown in Table 1, were examined under an optical microscope at 100× and 200×. Reduced dendrite formation and relatively even coating of lead (inside/outside foam) were observed. Initial observations show that the mass flow limitations were overcome.

The forced flow of electrolyte in a generally laminar direction through copper foam in the direction perpendicular to the main length and width dimensions has proven to be effective in providing an even coating of lead throughout the bulk of the foam. It is desirable for the rate of flow of electrolyte to be sufficient for the reduction in concentration of $Pb^{++}$ as the electrolyte passes through the foam, to be negligible; for the overall volume of the electrolyte to be sufficient that only a 10-20% reduction in $Pb^{++}$ concentration to occur during the electroplating procedure; and for the electrolyte flow direction to be reversed from time to time.

Though the foregoing specification has focused on plating copper with lead, it is contemplated that the principles described may apply to other appropriate metal pairs including a less electropositive metal as a substrate having a standard electrode potential generally greater than 0.0V, being plated by a suitable, more electropositive metal, having a standard electrode potential generally greater than −0.5V.

The description of the present application has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. Unless otherwise specified, the term "about" should be understood to mean within ±10% of the nominal value.

The descriptions above are intended to be illustrative, not limiting. Thus, it will be apparent to one skilled in the art that modifications may be made as described without departing from the scope of the claims set out below.

The invention claimed is:

1. An electroplating chamber, comprising:

a plating material source;

an electrolyte inlet, disposed on a first side of the plating material source;

an electrolyte outlet, disposed on an opposed, second side of the plating material source;

a plating position, disposed between the electrolyte inlet and the electrolyte outlet, and downstream of the plating material source, configured and arranged to hold a metal foam to be electroplated such that, in use, electrolyte passingfrom the electrolyte inlet to the electrolyte outlet is forced to flow through the metal foam with no by-pass by at least one barrier positionable ata free edge of the metal foam; and wherein, a plurality of passages are disposed upstream of the metal foam, and positioned and sized to, in use, compensate for drag produced by walls of the chamber, slowing fluid flow at a periphery of the metal foam.

2. An electroplating chamber as in claim 1, wherein the plurality of passages are disposed within the plating material source.

3. An electroplating chamber as in claim 1, wherein the plurality of passages are disposed within a barrier, separate from the plating material source.

4. An electroplating chamber as in claim 1, further comprising a second plating material source disposed between the plating position and the electrolyte outlet.

5. An electroplating chamber as in claim 1, wherein the plating position comprises a plurality of plating holders, each configured and arranged to hold a respective metal foam to be electroplated.

6. An electroplating chamber as in claim 1, wherein the electrolyte inlet and electrolyte outlet are reversible, such that a flow of electrolyte may be selectively reversed.

7. An electroplating chamber as in claim 1, further comprising a heater, configured and arranged to heat the chamber to a selected temperature during electroplating.

8. An electroplating chamber as in claim 1, further comprising an electrical source, configured and arranged to apply a voltage differential to the plating material source and the metal foam.

9. An electroplating chamber as in claim 1, wherein the plating material source comprises a plurality of openings configured to allow electrolyte flow therethrough.

* * * * *